US008973306B2

(12) United States Patent
Inaguchi

(10) Patent No.: US 8,973,306 B2
(45) Date of Patent: Mar. 10, 2015

(54) TWO-STAGE LINKED SLIDING DOOR OF MACHINE TOOL

(71) Applicant: Fanuc Corporation, Yamanashi (JP)

(72) Inventor: Yuuzou Inaguchi, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 0 days.

(21) Appl. No.: 13/688,498

(22) Filed: Nov. 29, 2012

(65) Prior Publication Data

US 2013/0219789 A1 Aug. 29, 2013

(30) Foreign Application Priority Data

Feb. 28, 2012 (JP) ..... 2012-040938

(51) Int. Cl.
*E05F 17/00* (2006.01)

(52) U.S. Cl.
CPC ..... *E05F 17/00* (2013.01); *E05Y 2900/608* (2013.01)
USPC ..... 49/118; 49/116; 49/404

(58) Field of Classification Search
CPC ..... E05F 17/00; E05F 15/145; F16H 7/08; E06B 11/045
USPC ..... 49/116, 118, 119, 120, 121, 123, 138, 49/404; 16/72, 78
See application file for complete search history.

(56) References Cited

U.S. PATENT DOCUMENTS 1,245,882 A * 11/1917 Davis ..... 49/102
1,681,545 A * 8/1928 Lang ..... 49/102
4,852,300 A * 8/1989 Keast ..... 49/102
4,957,600 A * 9/1990 Carlson et al. ..... 160/199
5,701,973 A * 12/1997 Tracey ..... 187/316
5,819,878 A * 10/1998 Barrett et al. ..... 187/324
6,352,097 B1 * 3/2002 Kern et al. ..... 160/197
7,287,805 B2 * 10/2007 Yamada et al. ..... 296/155
2004/0079592 A1 * 4/2004 Borneck ..... 187/318
2004/0221510 A1 * 11/2004 Fukumoto et al. ..... 49/360

FOREIGN PATENT DOCUMENTS

JP 2074778 A 3/1990
JP 451592 U 4/1992
JP 2006205337 A 8/2006

OTHER PUBLICATIONS

Decision to Grant a Patent for corresponding Patent Application No. 2012-040938 dated Mar. 7, 2013.

* cited by examiner

*Primary Examiner* — Katherine Mitchell
*Assistant Examiner* — Abe Massad
(74) *Attorney, Agent, or Firm* — Lowe Hauptman & Ham, LLP

(57) ABSTRACT

A two-stage linked sliding door of a machine tool is provided with a first door half and a second door half movable through different strokes. Pulleys are disposed individually at two opposite end portions of the second door half, and a wire is stretched between the pulleys. The opposite end portions of the wire are secured to the door frame or the first door half by two wire tensioning springs, individually, such that the opposite end portions face each other. These two springs are juxtaposed and offset with each other so that their respective central axes do not line on the same axis.

4 Claims, 7 Drawing Sheets

TWO-STAGE LINKED SLIDING DOOR OF MACHINE TOOL

RELATED APPLICATIONS

The present application is based on, and claims priority from, Japanese Application Number 2012-040938, filed Feb. 28, 2012, the disclosure of which is hereby incorporated by reference herein in its entirety.

BACKGROUND OF THE INVENTION

1. Field of the Invention

The present invention relates to a two-stage linked sliding door of a machine tool.

2. Description of the Related Art

A machining space of a machine tool is closed by a cover to prevent chips and coolant from being scattered to the outside. In this arrangement, a sliding door may be provided for loading and unloading workpieces.

For large workpieces, a two-stage sliding door can be advantageously used to provide a larger door opening width. To increase production efficiency, moreover, the door must be quickly opened and closed.

The door opening/closing speed can be smoothly increased by installing a mechanism for associating the operations of two door halves. A mechanism comprising a wire and pulleys is a known as means for interlocking the door halves. An example of this means applied to a machine tool is disclosed in Japanese Patent Application Laid-Open No. 2006-205337.

FIG. 7 is a view illustrating a prior art two-stage linked sliding door of a machine tool. As shown in FIG. 7, plate-like door halves 1 and 2 are attached to an opening (not shown) in a fixed cover of the machine tool, the door half 1 leaving the opening open. In a mechanism using pulleys 3 and 4 and a wire 5, the pulleys 3 and 4 are disposed individually on the opposite ends of a pulley fixing portion 6 that is secured to the door half 2 with a shorter stroke. The wire 5 is secured to the door half 1 with a longer stroke by a wire fixing portion 7.

The wire 5 is secured to a door frame 8 by means of wire tensioning springs 9 and 10. Thus, a wire tensioning spring supporting member 11 is secured to the door frame 8. One ends 9*b* and 10*b* of the wire tensioning springs 9 and 10 are anchored to a protrusion, such as a bolt, secured to the wire tensioning spring supporting member 11, while the other ends 9*a* and 10*a* are connected to ends 5*a* and 5*b*, respectively, of the wire 5. Since the wire ends 5*a* and 5*b* are secured to the wire tensioning spring supporting member 11 by means of the wire tensioning springs 9 and 10, the possibility of slacking of the wire 5 due to prolonged use is obviated, and a constant tension can be maintained. In this way, the wire 5 is prevented from being disengaged from the pulleys 3 and 4.

The following is a description of the operations of the door halves 1 and 2. If the door half 1 is moved to the right in the drawing (as indicated by an arrow 101) to close the opening in the fixed cover, the pulley 4, that is, the door half 2, like the door half 1, moves to the right in the drawing (as indicated by an arrow 102). Thereupon, the door halves 1 and 2 move in association with each other. The amount of movement of the door half 2 is half that of the door half 1.

In the above-described arrangement shown in FIG. 7, the wire tensioning springs 9 and 10 lie on the same axis in the direction of movement of the door halves 1 and 2 being opened or closed, so that the length (100) of a wire tensioning portion inevitably increases. In some machine tools, a locking mechanism may be attached to their automatic or non-automatic doors. Since chips and cutting fluid are scattered during machining, mechanical sections, including an automatic door opening and closing mechanism, locking mechanism, linkage mechanism, etc., are often intensively located on the door frame 8 or the like above the door that cannot be easily affected by chips and cutting fluid. Thus, an installation space for the linkage mechanism for the door halves 1 and 2 is limited, so that the mechanical sections are expected to be reduced in size and space.

SUMMARY OF THE INVENTION

Accordingly, in view of the above problems of the prior art, the object of the present invention is to provide a two-stage linked sliding door of a machine tool, in which a door linkage mechanism can be reduced in size and space.

A first aspect of a two-stage linked sliding door of a machine tool according to the present invention comprises: a two-stage sliding door attached to the machine tool, the sliding door comprising a first door half movable through a predetermined stroke and a second door half movable through a stroke shorter than that of the first door half and accommodated overlapping a fixed cover of the machine tool; two pulleys disposed individually at one and the other end portions of the second door half; a wire stretched between the two pulleys; a wire tension portion which secures the opposite end portions of the wire to one of a door frame and the first door half through two elastic members individually pulling the opposite end portions of the wire in a manner such that the opposite end portions of the wire face each other; and a wire intermediate portion fixing member which secures an intermediate portion of the wire between the two pulleys to the other of the door frame and the first door half. The two elastic members are juxtaposed and offset with each other so that the respective central axes thereof do not lie on the same axis.

The intermediate portion fixing member may be provided with a member configured to stagger the wire or the diameter of one of the two pulleys is made larger than that of the other pulley so that the wire extends parallel to the direction of movement of the door.

A second aspect of a two-stage linked sliding door of a machine tool according to the present invention comprises: a two-stage sliding door attached to the machine tool, the sliding door comprising a first door half movable through a predetermined stroke and a second door half movable through a stroke shorter than that of the first door half and accommodated overlapping a fixed cover of the machine tool: two pulleys disposed individually at one and the other end portions of the second door half; and two wires passed individually around the two pulleys, one end of each of the wires being secured to a door frame and the other end to the first door half. The one or the other ends of the two wires is secured to the door frame or the first door half by means of two elastic members, and the two elastic members are juxtaposed and offset with each other so that the respective central axes thereof do not lie on the same axis.

Those end portions of the two wires which are secured to the door frame or the first door half without the use of the elastic members may be secured to the first door half or the door frame by means of members which partially stagger the wires so that the wires extend parallel to the direction of movement of the door.

According to the present invention, there can be provided a two-stage linked sliding door of a machine tool, in which a door linkage mechanism can be reduced in size and space.

BRIEF DESCRIPTION OF THE DRAWINGS

The above and other objects and features of the present invention will be obvious from the ensuing description of embodiments with reference to the accompanying drawings, in which.

DETAILED DESCRIPTION OF THE PREFERRED EMBODIMENTS

Figure 1:
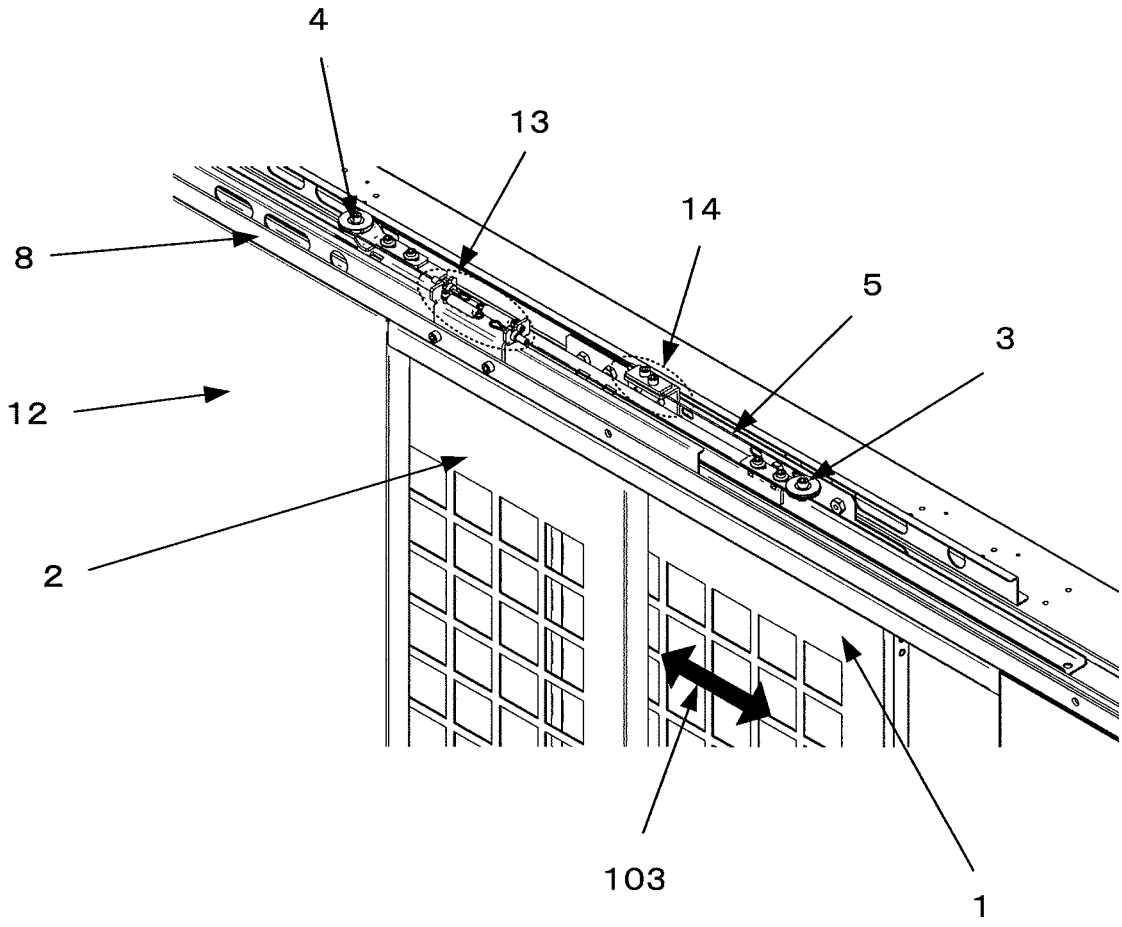
FIG. 1 is a perspective view illustrating a first embodiment of a two-stage linked sliding door of a machine tool according to the present invention.

A two-stage linked sliding door of a machine tool according to the present invention has a wire tensioning structure such that an installation space for wire tensioning springs attached to the ends of a wire that is stretched between two pulleys is reduced by non-coaxially arranging the springs so that the springs overlap in parallel with each other. Further, the linked sliding door has a structure such that the wire is located parallel to the direction of door operation in order to prevent any other force than a force in this direction from acting on the door.

A first embodiment of the two-stage linked sliding door of a machine tool according to the present invention will first be described with reference to FIG. 1.

A first door half 1 and a second door half 2 configured to open and close an opening in a fixed cover 12 that covers the machine tool are accommodated overlapping the cover 12.

A wire tensioning portion 13 is secured to a door frame 8, and a wire fixing portion 14 is secured to the first door half 1. One end of a wire 5 is secured to the wire tensioning portion 13, while the other end is secured to the wire tensioning portion 13 through a pulley 3, the wire fixing portion 14, and a pulley 4. Thus, the opposite ends of the wire 5 are relatively secured to the wire tensioning portion 13 in a manner such that they face each other.

The first door half 1 performs opening/closing operation in the direction of an arrow 103. The first and second door halves 1 and 2, each in the form of a plate, are operated in association with each other by a linkage mechanism, which comprises the pulleys 3 and 4, wire 5, wire tensioning portion 13, and wire fixing portion 14. Thus, the first and second door halves 1 and 2 constitute the two-stage linked sliding door. The movement stroke of the second door half 2 is shorter than that of the first door half 1, and the movement speed of the second door half 2 during opening/closing operation is half that of the first door half 1. The wire fixing portion 14 that constitutes the linkage mechanism is an example of an intermediate portion fixing member.

Figure 2:
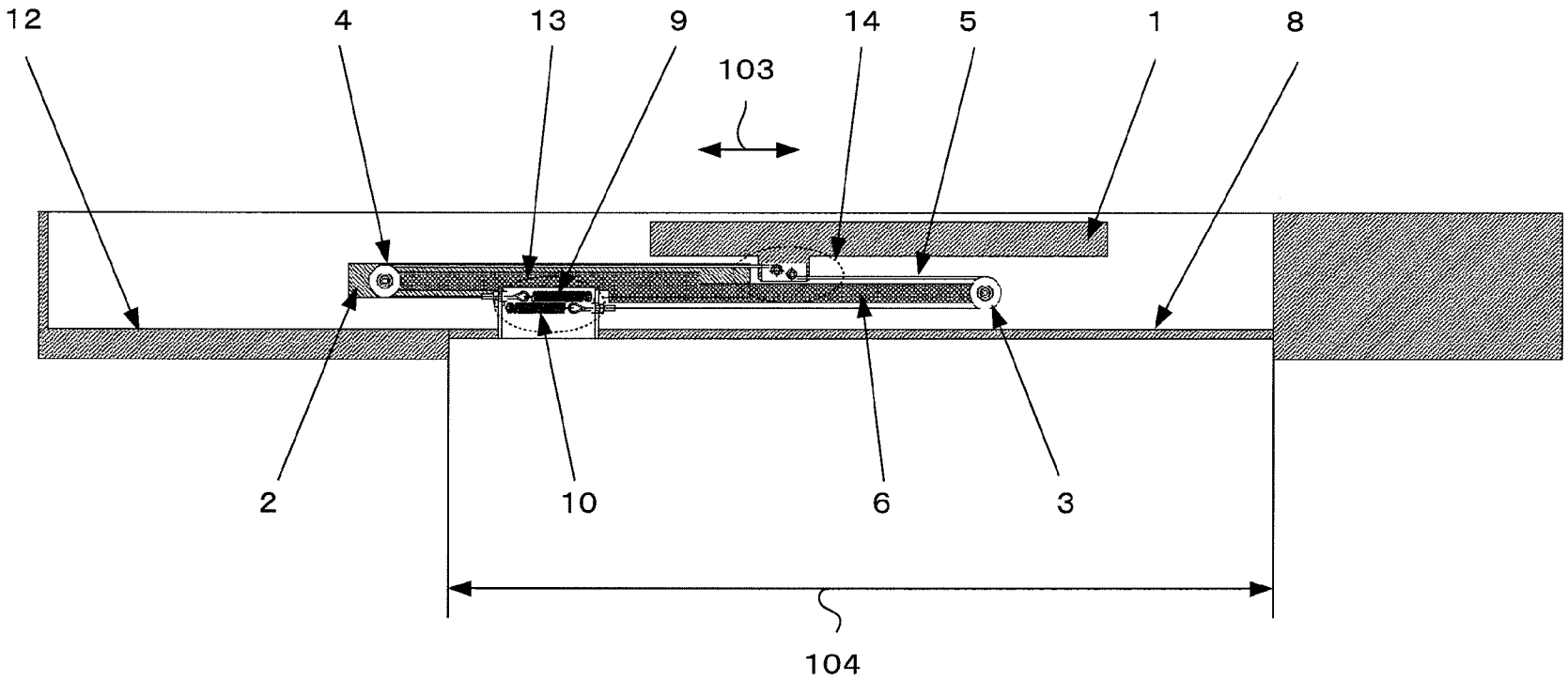
FIG. 2 is a top view of a linkage mechanism of the sliding door shown in FIG. 1.

FIG. 2 is a top view of the linkage mechanism of the sliding door shown in FIG. 1. The first door half 1 is a plate-like door with a long stroke, while the second door half 2 is a plate-like door with a short stroke that operates in association with the first door half 1. The first door half 1 is fitted with the wire fixing portion 14 that fixes the wire 5. A pulley fixing portion 6 is secured to the second door half 2, and the pulleys 3 and 4 are mounted individually on the opposite end portions of the pulley fixing portion 6. The wire tensioning portion 13, which serves to fix the opposite end portions of the wire 5 by means of two wire tensioning springs 9 and 10, is secured to the door frame 8 on the fixed cover 12 by fixing means such as bolts. Reference numeral 104 denotes a door frame opening width.

A principal part of the linkage mechanism of the sliding door shown in FIG. 2 will be described with reference to FIG. 3.

Figure 3:
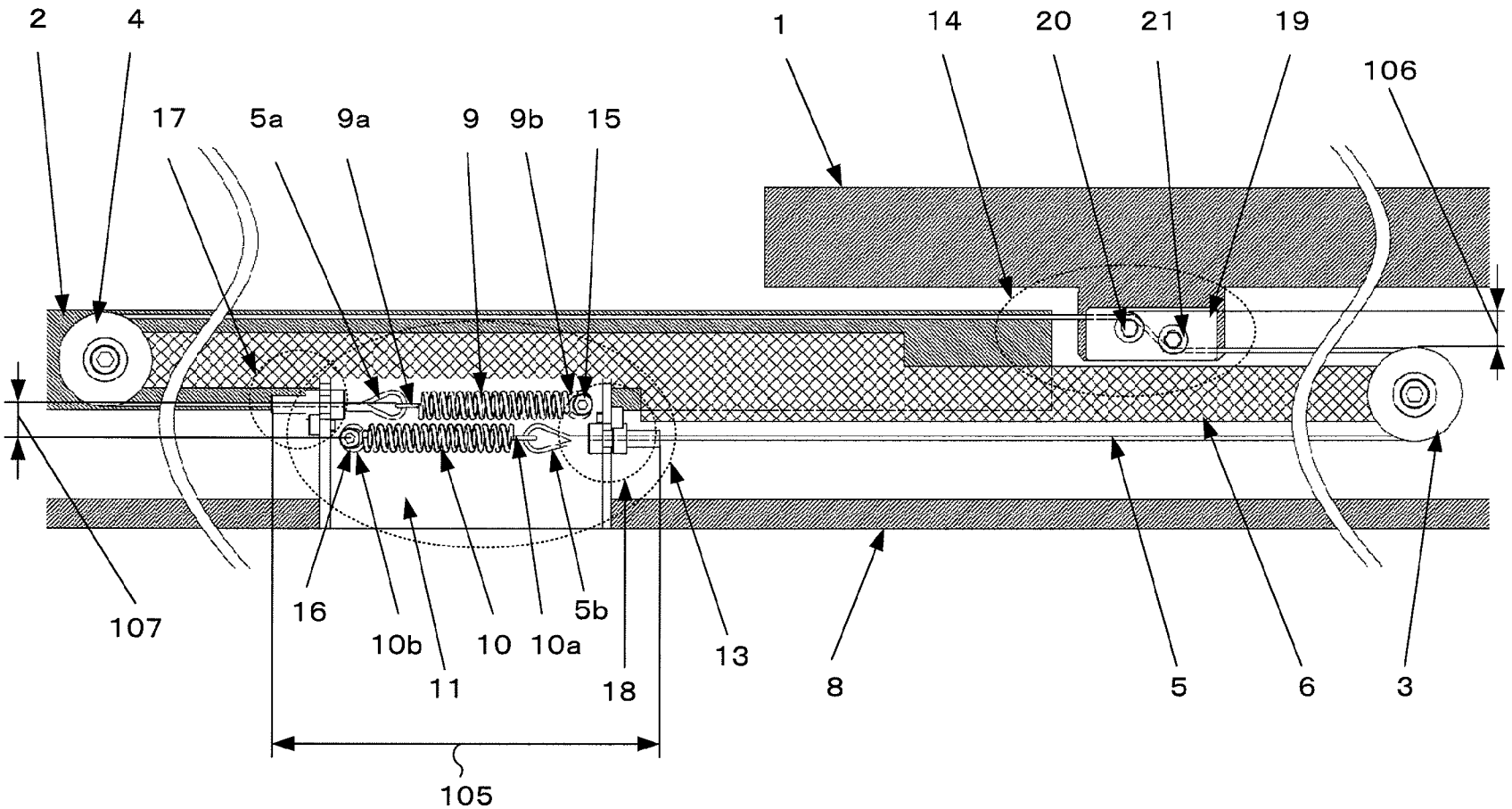
FIG. 3 is a view illustrating a principal part of the linkage mechanism of the sliding door shown in FIG. 2.

As shown in FIG. 3, the wire fixing portion 14 is secured to the first door half 1, and the wire tensioning portion 13 is secured to the door frame 8. The pulley fixing portion 6 is secured to the second door half 2, and the pulleys 3 and 4 are mounted individually on the opposite end portions of the pulley fixing portion 6. The pulleys 3 and 4 are mounted on the pulley fixing portion 6 in such a manner that they are not located on the same axis with respect to the direction of movement for opening/closing operations of the first and second door halves 1 and 2.

The wire fixing portion 14 secured to the first door half 1 comprises a wire fixing member 19 for setting the wire 5 and bolts 20 and 21 secured to the fixing member 19. The bolts 20 and 21 are mounted on the wire fixing member 19 in such a manner that they are staggered perpendicular to the movement direction of the fixing portion for opening/closing operation. The wire 5 is stretched between the bolts 20 and 21 in such a manner that it is offset perpendicular to its central axis. In FIG. 3, reference numeral 106 denotes an offset width of the wire 5. Thus, the wire 5 stretched between the bolts 20 and 21 is tightened by these bolts 20 and 21 so that it cannot move relative to the bolts 20 and 21.

Figure 7:
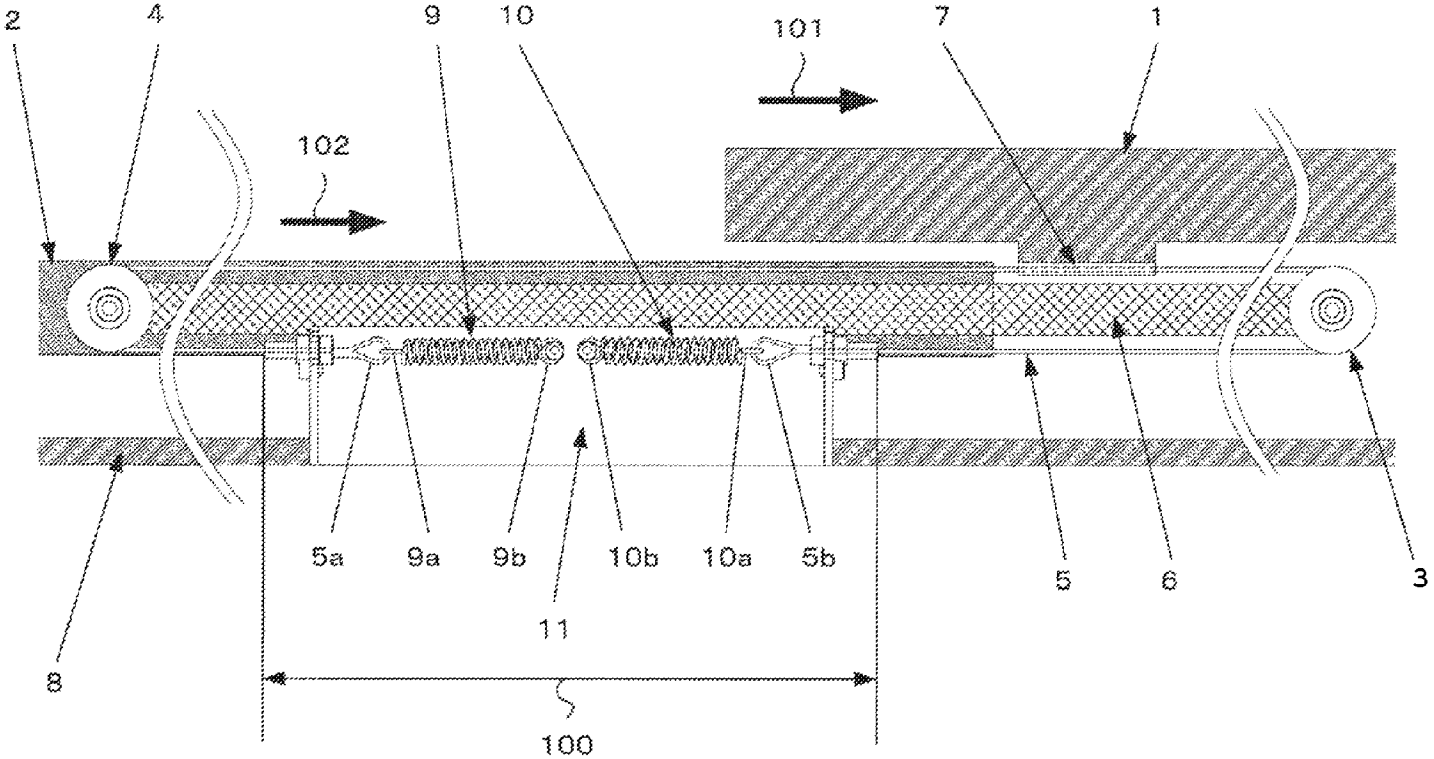
FIG. 7 (PRIOR ART)
FIG. 7 is a view illustrating a prior art two-stage linked sliding door of a machine tool.

Further, the wire tensioning portion 13 comprises a wire tensioning spring supporting member 11 and bolts 15 and 16 for fixing the opposite end portions of the wire 5 by means of the wire tensioning springs 9 and 10, respectively. In the wire tensioning portion 13, as shown in FIG. 3, the two wire tensioning springs 9 and 10 are juxtaposed and offset with each other so that their respective central axes do not lied on the same axis. In FIG. 3, reference numeral 107 denotes an offset amount between the juxtaposed wire tensioning springs 9 and 10. Since the first and second wire tensioning springs 9 and 10 in the wire tensioning portion 13 are arranged parallel to each other in their axial direction, a wire tensioning portion length 105 of the wire tensioning portion 13, which is an installation space for the wire tensioning springs 9 and 10, can be made shorter than in the prior art case (see reference numeral 100 of FIG. 7).

One end portion 9*b* of the first wire tensioning spring 9 is anchored to the bolt 15, while the other end portion 9*b* is connected to one end portion 5*a* of the wire 5. Further, on end portion 10*b* of the second wire tensioning spring 10 is anchored to the bolt 16, while the other end portion 10*b* is connected to the other end portion 5*b* of the wire 5. The wire 5 extending from the one end portion 5*a* passes through a wire receiving portion 17, the pulley 4, the wire fixing portion 14, the pulley 3, and a wire receiving portion 18, and is connected at its other end portion 5*b* to the other end portion 10*a* of the wire tensioning spring 10. Since the wire 5 is movable along its central axis in the wire receiving portions 17 and 18, the extension and contraction of the wire 5 can be absorbed by the wire tensioning springs 9 and 10.

A second embodiment of the two-stage linked sliding door of a machine tool according to the present invention will now be described with reference to FIG. 4.

The following is a description of only those portions of the second embodiment which are different from their counterparts in the first embodiment of the present invention, so the description of the same constituent elements of the second embodiment as those of the first embodiment is omitted here, by referring to the description of the first embodiment with reference to FIGS. 1 to 3.

Figure 4:
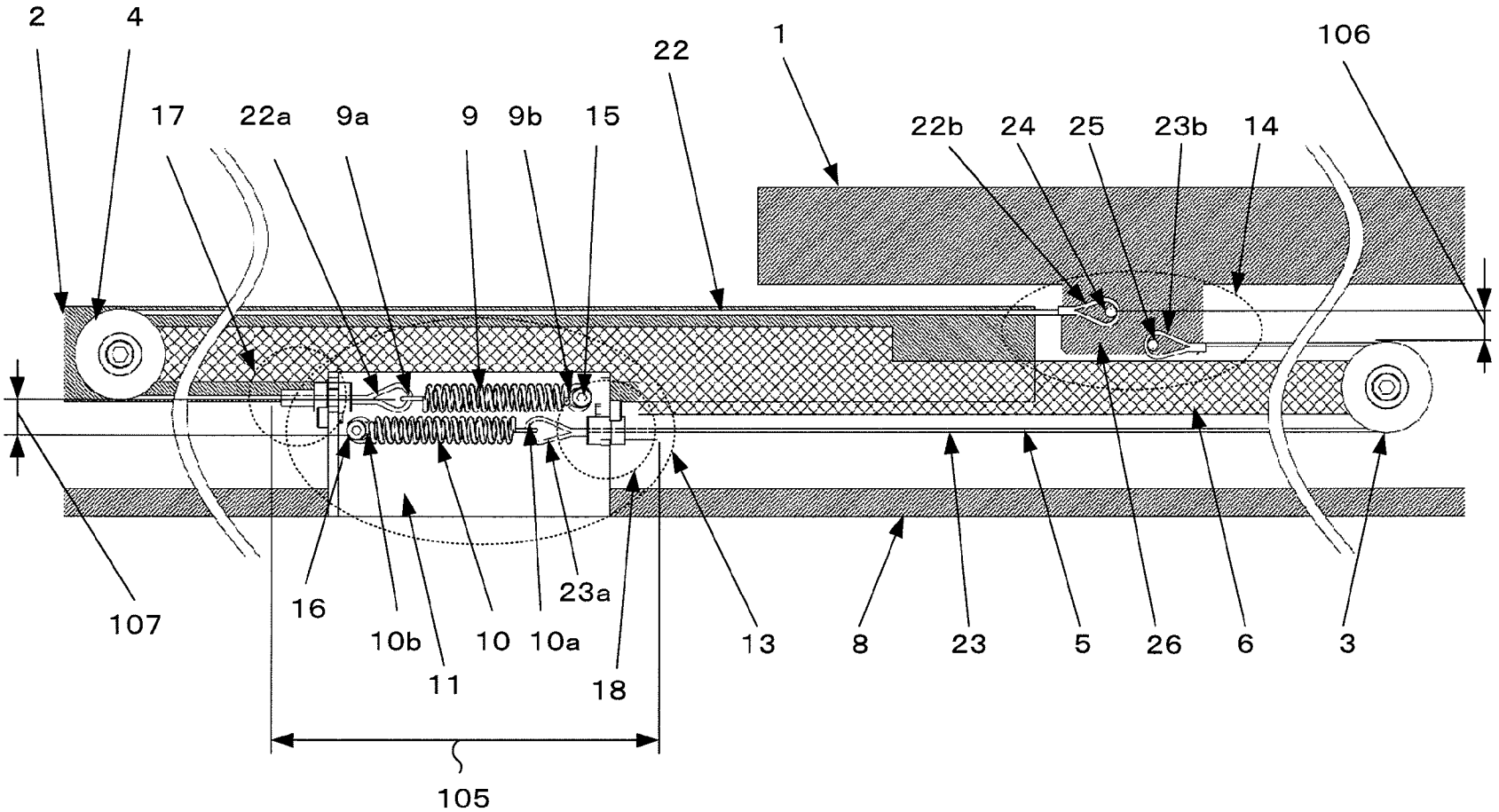
FIG. 4 is a view illustrating a second embodiment of the two-stage linked sliding door of a machine tool according to the present invention.

As shown in FIG. 4, the present embodiment uses two wires, that is, first and second wires 22 and 23. Further, pins 24 and 25 are secured to a projection 26 of a first door half 1. One end 22*a* of the first wire 22 is connected to one end of a wire tensioning spring 9*a*, while the other end 22*b* is anchored to the pin 24 secured to the first door half 1. Likewise, one end 23*a* of the second wire 23 is connected to one end of a wire tensioning spring 10*a*, while the other end 23*b* is anchored to the pin 25 secured to the first door half 1.

Figure 5:
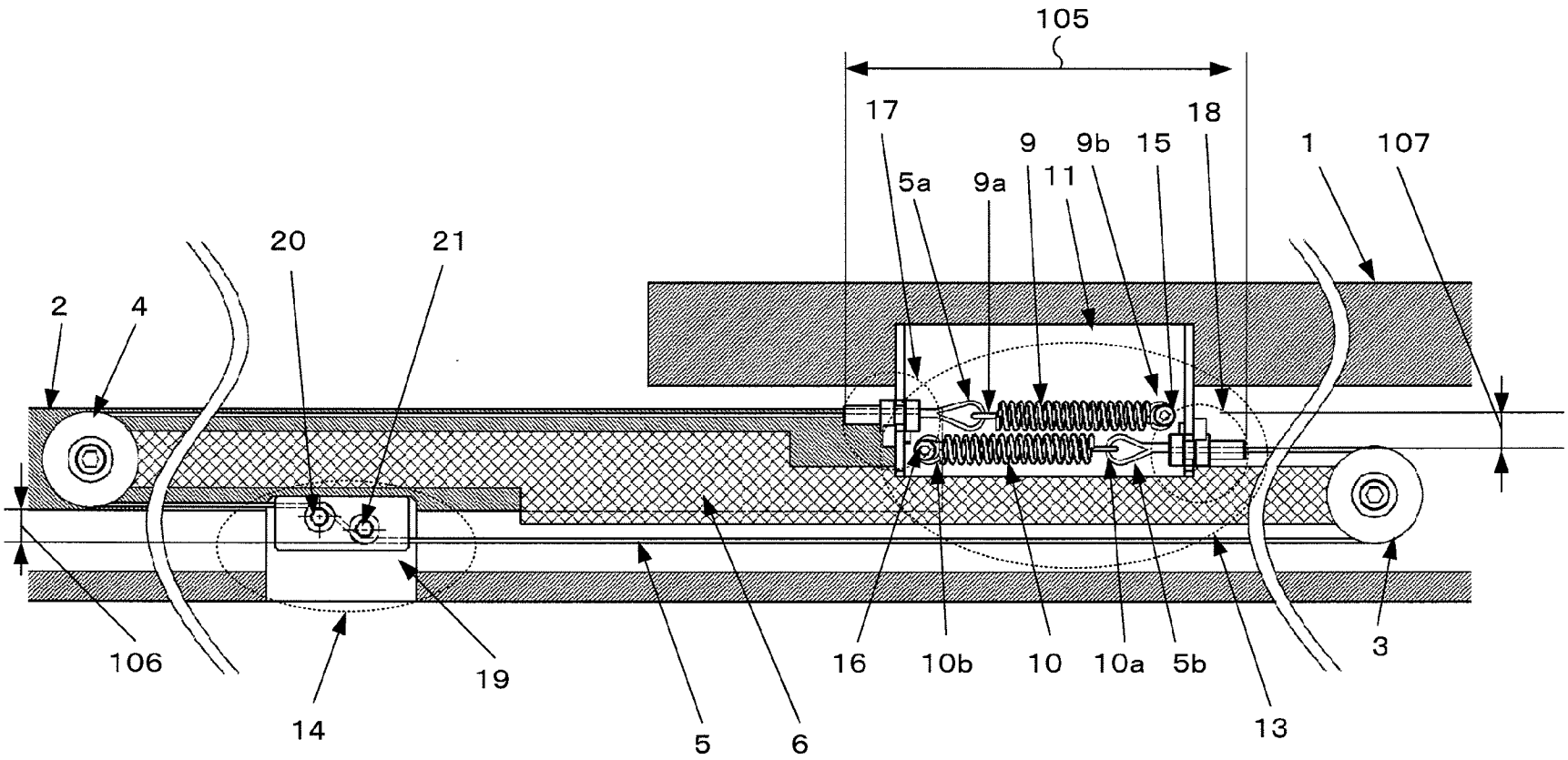
FIG. 5 is a view illustrating a third embodiment of the two-stage linked sliding door of a machine tool according to the present invention.

A third embodiment of the two-stage linked sliding door of a machine tool according to the present invention will now be described with reference to FIG. 5.

In the third embodiment, a wire tensioning portion 13 and a wire fixing portion 14 are attached to a first door half 1 and a door frame 8, respectively. Since other constituent elements are the same as those of the first embodiment described with reference to FIGS. 1 to 3, a description of those elements is omitted.

Figure 6:
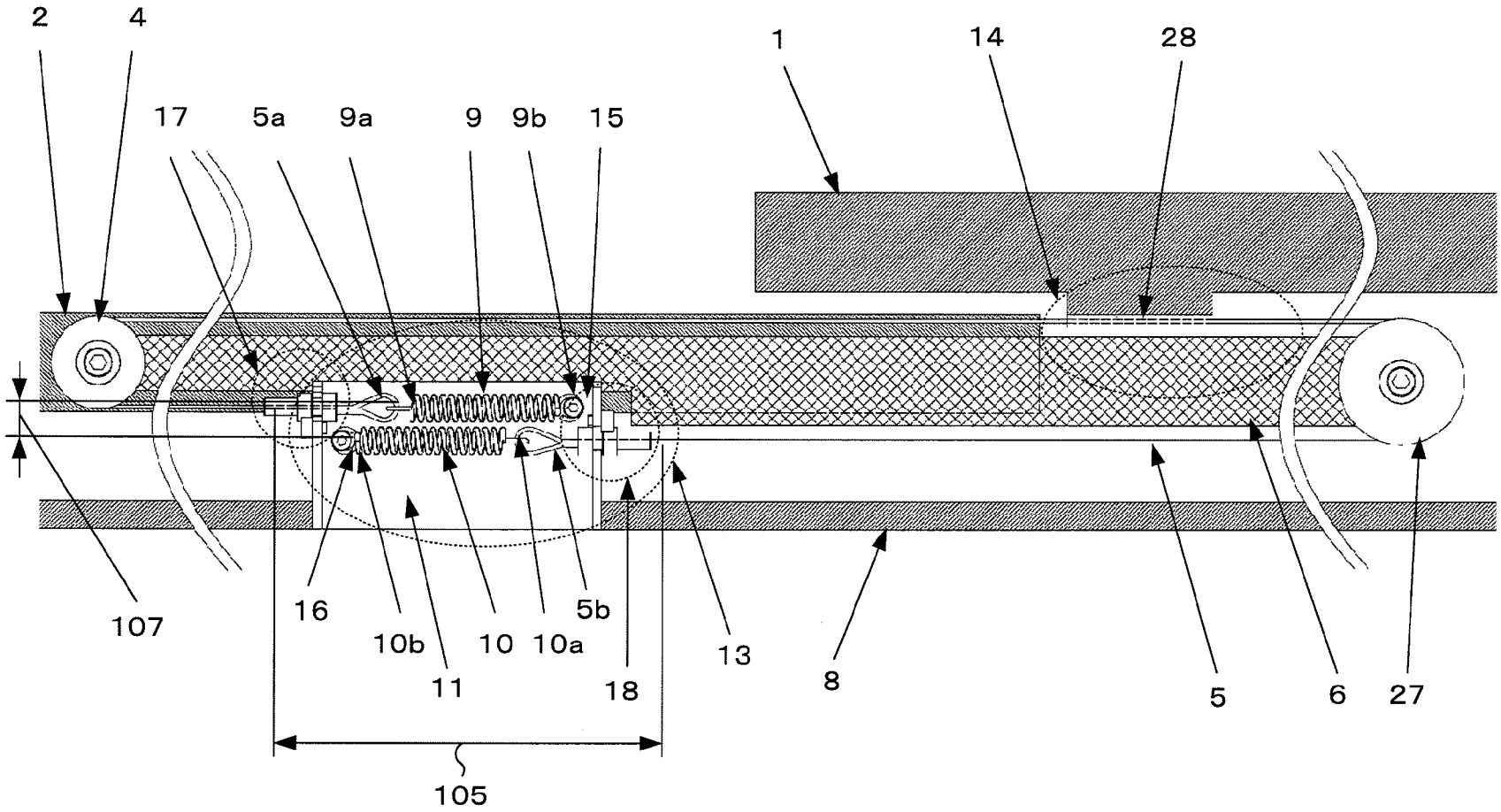
FIG. 6 is a view illustrating a fourth embodiment of the two-stage linked sliding door of a machine tool according to the present invention.

A fourth embodiment of the two-stage linked sliding door of a machine tool according to the present invention will now be described with reference to FIG. 6.

In the first to third embodiments of the two-stage linked sliding door of a machine tool according to the present invention described above, the two pulleys used are given the same radius. In the fourth embodiment, however, two pulleys used are given different radii.

The radius of a pulley 27 (one of the two pulleys 4, 27) is made larger than that of the other pulley 4, whereby the axial position of a wire 5 can be offset by a margin equivalent to the difference between the respective radii of the pulleys 4 and 27. Thus, in the present embodiment, a wire fixing portion 14 need not be configured to offset the wire 5 and may be configured only to tighten and fix the wire 5.

In any of the first to fourth embodiments of the two-stage linked sliding door of a machine tool according to the present invention, the wires 5, 22 and 23 may be replaced with ropes, cords, steel cables, belts, or chains. Further, pulleys, sprockets, etc., may be used for the pulleys 3, 4 and 27, depending on the types of wires used. Furthermore, rubber-like elastic members may be used in place of the springs as the members for tensioning the wires 5, 22 and 23.

The invention claimed is:

1. A two-stage linked sliding door of a machine tool, the sliding door comprising:

a first door half movable through a predetermined stroke and a second door half movable through a stroke shorter than that of the first door half to open and close an opening in a fixed cover of the machine tool;

two pulleys disposed respectively at opposite end portions of the second door half;

a wire stretched between the two pulleys;

a wire tensioning portion which secures both opposite first and second end portions of the wire, respectively through two elastic members of the wire tensioning portion, to one of a door frame on the fixed cover and the first door half, the two elastic members respectively pulling the opposite first and second end portions of the wire to provide a tension in the wire; and a wire intermediate portion fixing member which secures an intermediate portion of the wire between the two pulleys to the other of the door frame and the first door half, wherein the two elastic members are juxtaposed and offset with each other so that respective central axes of the two elastic members do not lie on the same axis, the wire intermediate portion fixing member is provided with a member configured to stagger the wire in a direction in which the first and second door halves are overlapped, the wire has a first section extending between the wire intermediate portion fixing member and the first end portion secured to one of the elastic members, and a second section extending between the wire intermediate portion fixing member and the second end portion secured to the other one of the elastic members, and the member of the wire intermediate portion fixing member is configured to stagger the first section and the second section of the wire so that the first section and the second section of the wire extend parallel to each other and to a direction of movement of the first and second door halves.

2. The two-stage linked sliding door according to claim 1, wherein the wire tensioning portion is attached to the first door half, and the wire intermediate portion fixing member is attached to the door frame.

3. The two-stage linked sliding door according to claim 1, wherein the first and second sections are first and second individual wires, respectively.

4. The two-stage lined sliding door according to claim 3, wherein the first wire has an end opposing to the first end portion and fixed to the wire intermediate portion fixing member, and the second wire has an end opposing to the second end portion and fixed to the wire intermediate portion fixing member.

* * * * *